US006452345B1

(12) United States Patent
Okura

(10) Patent No.: US 6,452,345 B1
(45) Date of Patent: Sep. 17, 2002

(54) DISCHARGE LAMP OPERATING DEVICE

(75) Inventor: Susumu Okura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/890,571

(22) PCT Filed: Sep. 13, 2000

(86) PCT No.: PCT/JP00/06275

§ 371 (c)(1),
(2), (4) Date: Sep. 20, 2001

(87) PCT Pub. No.: WO01/20952

PCT Pub. Date: Mar. 22, 2001

(30) Foreign Application Priority Data

Sep. 14, 1999 (JP) ..... 11-260288

(51) Int. Cl.[7] ..... G05F 1/00

(52) U.S. Cl. ..... 315/307; 315/224; 315/209 R; 315/82; 315/DIG. 7

(58) Field of Search ..... 315/307, 224, 315/225, 247, 289, 209 R, 82, DIG. 7, DIG. 5

(56) References Cited

U.S. PATENT DOCUMENTS 5,151,631 A * 9/1992 Oda et al. ..... 307/10.8
5,295,036 A * 3/1994 Yagi et al. ..... 361/79
5,485,061 A * 1/1996 Ukita et al. ..... 315/209 R
5,589,742 A * 12/1996 Ueda ..... 315/219
5,706,185 A * 1/1998 Toyama et al. ..... 315/127

FOREIGN PATENT DOCUMENTS

| | | |
|---|---|---|
| JP | 7-298613 | 11/1995 |
| JP | 8-78178 | 3/1996 |
| JP | 195333103 | 3/1996 |
| JP | 8-203687 | 8/1996 |
| JP | 8-250289 | 9/1996 |
| JP | 9-117150 | 5/1997 |
| JP | 11-67483 | 3/1999 |

* cited by examiner

*Primary Examiner*—Haissa Philogene
(74) *Attorney, Agent, or Firm*—Sughrue Mion, PLLC

(57) ABSTRACT

The present invention provides a lighting device of a discharge lamp, which lights the discharge lamp by feeding power to the discharge lamp, comprising a voltage detecting section which detects voltage impressed on the discharge lamp, and a lighting stop determining section which determines, on the basis of the voltage detected by the voltage detecting section, whether or not a short-circuit or a ground-fault occurs in a power feed line to the discharge lamp, and stops lighting in response to the result of the determination, wherein determination whether or not a ground-fault or a short-circuit occurs is not made for a prescribed period of time after dielectric breakdown of the discharge lamp or for a prescribed period of time after flow of a prescribed current to the discharge lamp. It is therefore possible to prevent an erroneous detection caused by use of an unstable bulb voltage in the initial stage of lighting.

3 Claims, 12 Drawing Sheets

DISCHARGE LAMP OPERATING DEVICE

TECHNICAL FIELD

The present invention relates to a lighting device of a discharge lamp used for a headlight of an automobile.

BACKGROUND ART

There are conventionally known a lighting device of a discharge lamp which detects a short-circuit or an opening of the discharge lamp and forcedly stops lighting. As an example of such a lighting device of a discharge lamp, Japanese Unexamined Patent Application Publication No. 8-106986 discloses a device which detects a bulb voltage of the discharge lamp, determines occurrence of a short-circuit or an opening of the discharge lamp by comparing the detected voltage to a prescribed set value, and forcedly discontinues lighting of the discharge lamp.

In the conventional discharge lamp lighting device, however, a short-circuit of the discharge lamp is determined by means of the bulb voltage of the discharge lamp in the initial stage of lighting. Because the bulb voltage in the initial stage of lighting is unstable, however, an erroneous determination of short-circuit of the discharge lamp may cause stoppage of lighting. When conditions for threshold value to prevent erroneous determination are alleviated, occurrence of a short-circuit of the discharge lamp may sometimes be determined as being normal.

The present invention was developed to solve the problems as described above, and has an object to provide a lighting device of a discharge lamp which never stops lighting of the discharge lamp as a result of erroneous determination such as that of a short-circuit of the discharge lamp.

It is another object of the invention to provide a lighting device of a discharge lamp which, upon actual occurrence of a short-circuit, can ensure stoppage of lighting.

DISCLOSURE OF INVENTION

The present invention provides a lighting device of a discharge lamp, which lights the discharge lamp by feeding power to the discharge lamp, comprising a voltage detecting section which detects voltage impressed on the discharge lamp, and a lighting stop determining section which determines, on the basis of the voltage detected by the voltage detecting section, whether or not a short-circuit or a ground-fault occurs in a power feed line to the discharge lamp, and stops lighting in response to the result of the determination, wherein determination whether or not a ground-fault or a short-circuit occurs is not made for a prescribed period of time after dielectric breakdown of the discharge lamp or for a prescribed period of time after flow of a prescribed current to the discharge lamp. It is therefore possible to prevent an erroneous detection caused by use of an unstable bulb voltage in the initial stage of lighting.

The invention provides also a lighting device of a discharge lamp, further comprising an igniter which feeds an initial voltage for causing dielectric breakdown of the discharge lamp, wherein the igniter is arranged on the side of the discharge lamp not grounded in the initial stage of lighting; and the lighting stop determining section determines whether or not a ground-fault occurs on the igniter side of the discharge lamp before dielectric breakdown of the discharge lamp. The lighting stop determining section would therefore determine whether or not a ground-fault occurs in a voltage impressed on the non-grounded side of the discharge lamp before dielectric breakdown of the discharge lamp. Current resulting from ground-fault flows during a prescribed time of non-determination, and temperature of the circuit element through which the current flows increases and there is a change in resistance value. After the lapse of a prescribed period of time, the voltage detecting section detects a higher voltage. The invention thus permits prevention of the resultant impossibility to detect a ground-fault.

The invention provides also a lighting device of a discharge lamp, further comprising an igniter which feeds an initial voltage for causing dielectric breakdown of the discharge lamp, wherein the igniter is arranged on the side of the discharge lamp grounded in the initial stage of lighting; and the lighting stop determining section determines whether or not a ground-fault occurs on any or both of the terminals on the both sides of the discharge lamp before dielectric breakdown of the discharge lamp. The lighting stop determining section can determine whether or not a ground-fault occurs as to the voltage impressed on any one or both of the terminals of the discharge lamp before dielectric breakdown of the discharge lamp, in the lighting device of the discharge lamp in which the igniter is arranged on the side grounded in the initial stage of lighting from among the output terminals of the inverter. Current resulting from ground-fault flows during a prescribed time of non-determination, and temperature of the circuit element through which the current flows increases and there is a change in resistance value. After the lapse of a prescribed period of time, the voltage detecting section detects a higher voltage. The invention permits prevention of the resultant impossibility to detect a ground-fault.

BEST MODE OF CARRYING OUT THE INVENTION

The present invention will now be described further in detail by means of the best embodiments for application of the invention with reference to the attached drawings.

Embodiment 1

An embodiment of the invention will be described.

Figure 1:
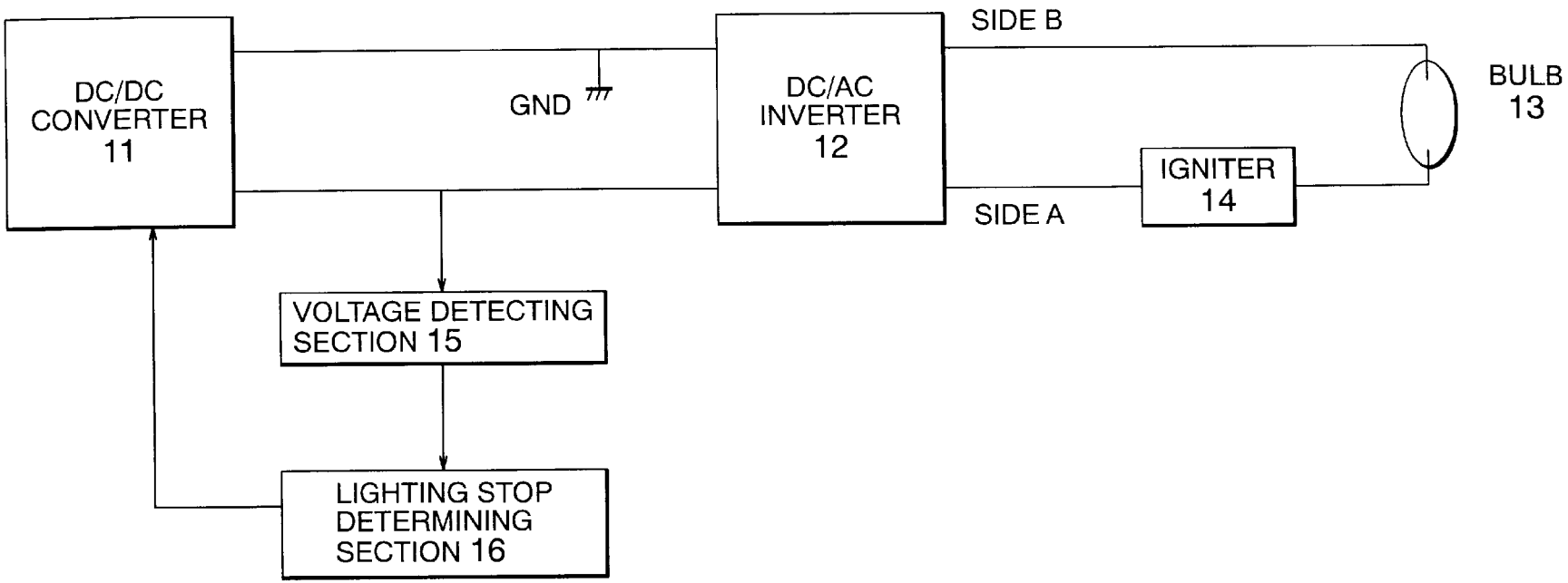
FIG. 1 is a block diagram illustrating the functional configuration of the discharge lamp lighting device of embodiment 1 of the present invention.

FIG. 1 is a block diagram illustrating the discharge lamp lighting device in this embodiment of the invention.

In FIG. 1, 11 represents a DC/DC converter which increases a source voltage fed from a DC power source such as an automobile battery and outputs a high voltage; 12, a DC/AC inverter which converts DC output from the DC/DC converter 11 into AC, and outputs the result of conversion, this DC/AC inverter 12 comprising an H bridge circuit; 13, a bulb, onto which AC output from the DC/AC inverter 12 is impressed, comprising a light-emitting tube housing a pair of electrodes and an ionizable sealed material; and 14, an igniter arranged between the DC/AC inverter 12 and the bulb 13. The igniter 14 causes dielectric breakdown in the bulb 13, thereby generating arc discharge, by further increasing the output voltage of the DC/AC inverter 12 at the start of lighting of the bulb 13 and outputting it to the bulb 13.

A voltage detecting section 15 is connected to the output side of the DC/DC converter 11. The voltage detection will be described later in detail.

Also in FIG. 1, 16 represents a lighting stop determining section which determines whether or not a ground-fault occurs, and whether or not a short-circuit occurs in the discharge lamp or in the power feed line to the discharge lamp on the basis of the voltage detected by the voltage detecting section 15 in accordance with a determination flow described later, thereby deciding whether or not to continue or stop the lighting operation, and discontinue lighting by controlling the DC/DC converter 11.

This lighting stop determining section 16 may be achieved, for example, by use of a microcomputer comprising a CPU and a memory.

Figure 2:
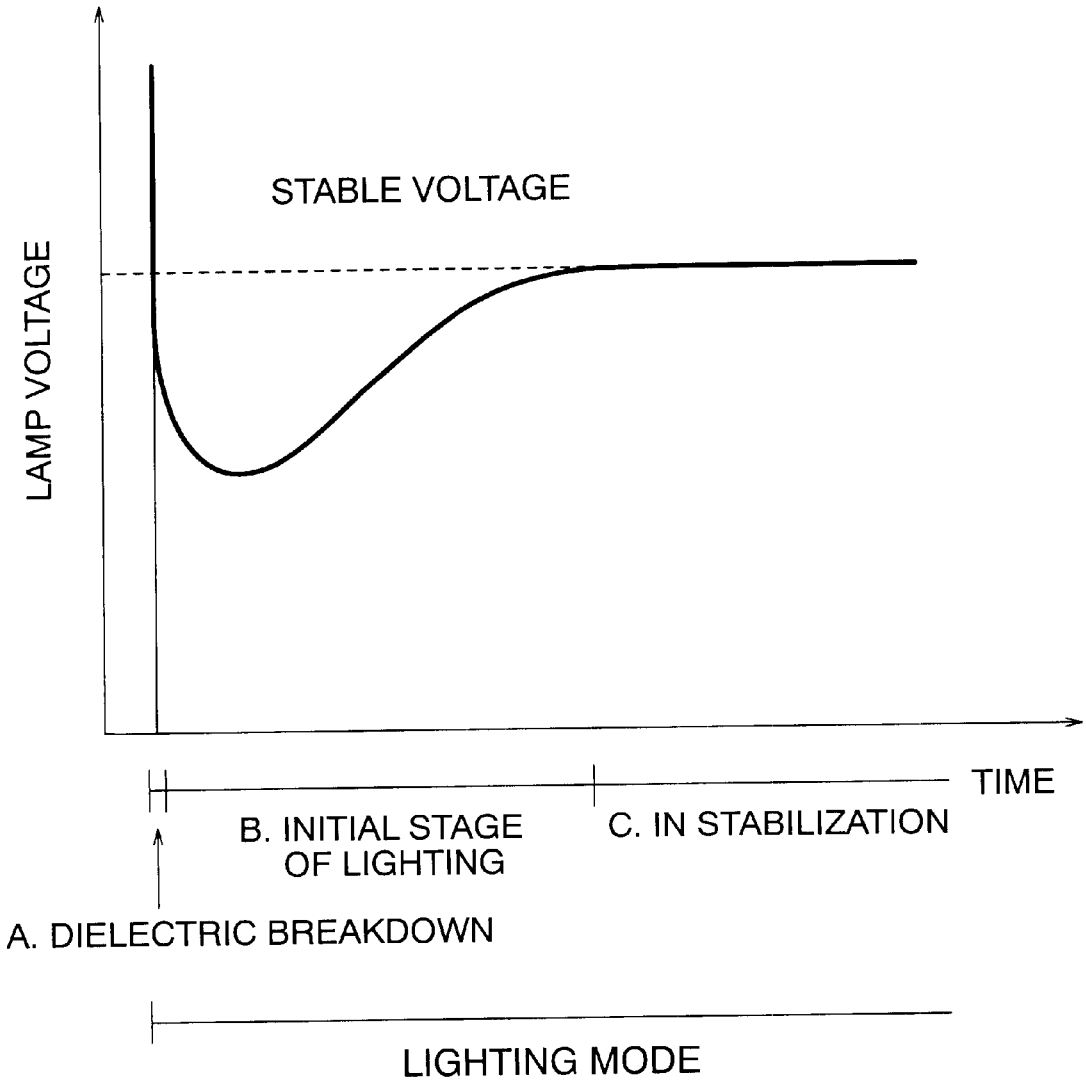
FIG. 2 is a characteristic diagram illustrating changes in bulb voltage during bulb lighting in the discharge lamp lighting device.

Operation of the discharge lamp lighting device will now be described with reference to FIG. 2.

Dielectric breakdown takes place in the bulb 13 and arc discharge is generated by further increasing the DC voltage fed from the battery by means of the igniter 14 and feeding the same to the bulb 13. As a result, the bulb voltage suddenly becomes higher until occurrence of dielectric breakdown as shown by "A. Dielectric breakdown" in FIG. 2, and the voltage drops after occurrence of dielectric breakdown.

Occurrence of dielectric breakdown causes the igniter 14 to discontinue operation. Output of the DC/AC inverter 12 continuously produces arc discharge, resulting in a light emitting state. In this state, voltage increases gradually from voltage drop after dielectric breakdown to a stable voltage as shown in "B. Initial stage of lighting" in FIG. 2.

After stabilization of the bulb voltage, arc discharge continues to take place under a stable bulb voltage, resulting in continuance of light emission as shown in "C. In stabilization" in FIG. 2.

Determination of short-circuit and ground-fault in the lighting stop determining section 16 will now be described with reference to FIGS. 3, 4, 5, 6 and 7.

Determination of short-circuit and ground-fault includes a bulb voltage reading process, a short-circuit/ground-fault detecting process and an output operation continuing process, and is executed as one of the control routines of the discharge lamp lighting device.

First, the short-circuit/ground-fault detecting process will be described with reference to FIGS. 3 and 4.

Figure 3:
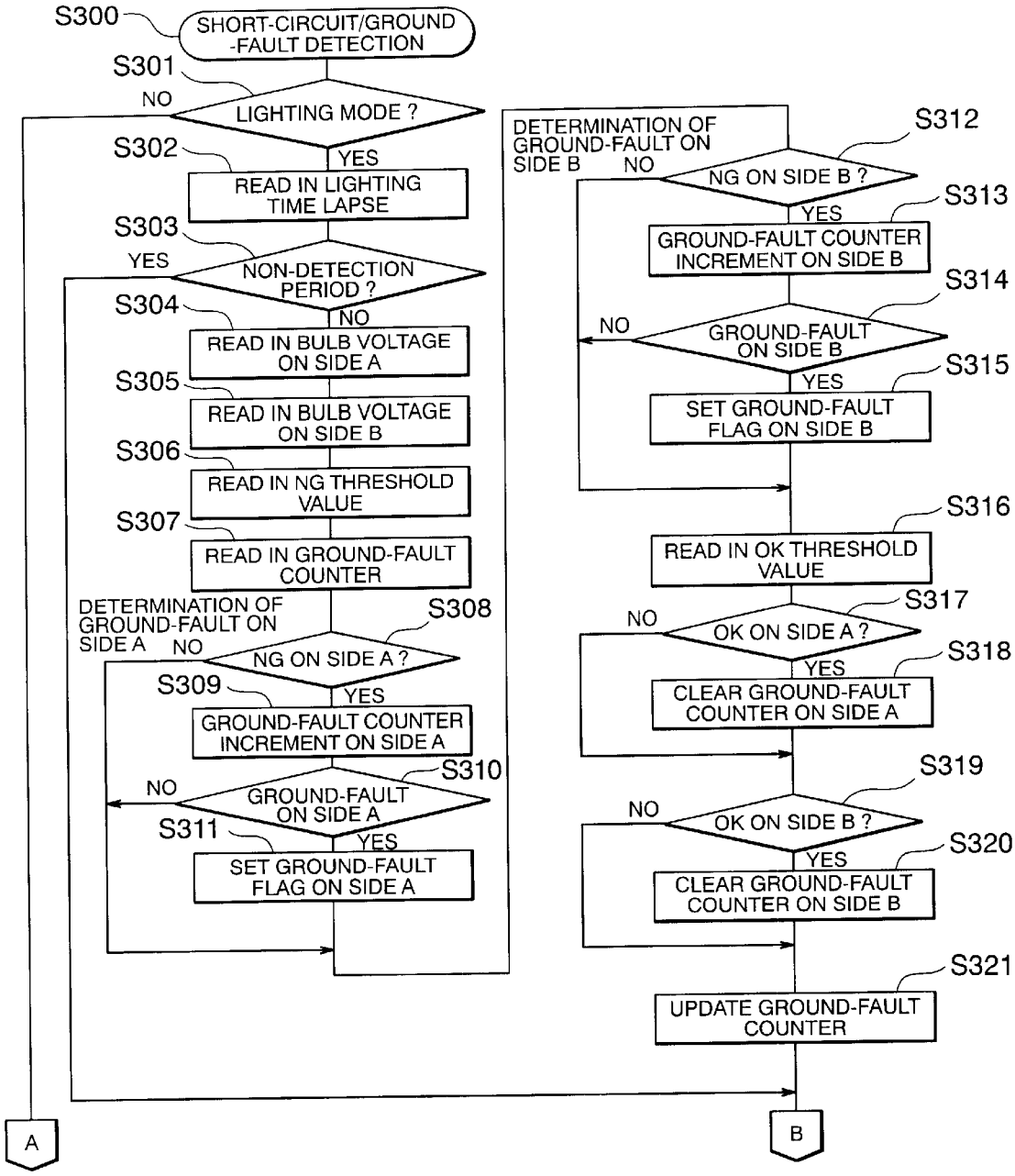
FIG. 3 is a flowchart illustrating the short-circuit ground-fault determining process in embodiment 1 of the invention, together with FIG. 4.
Figure 4:
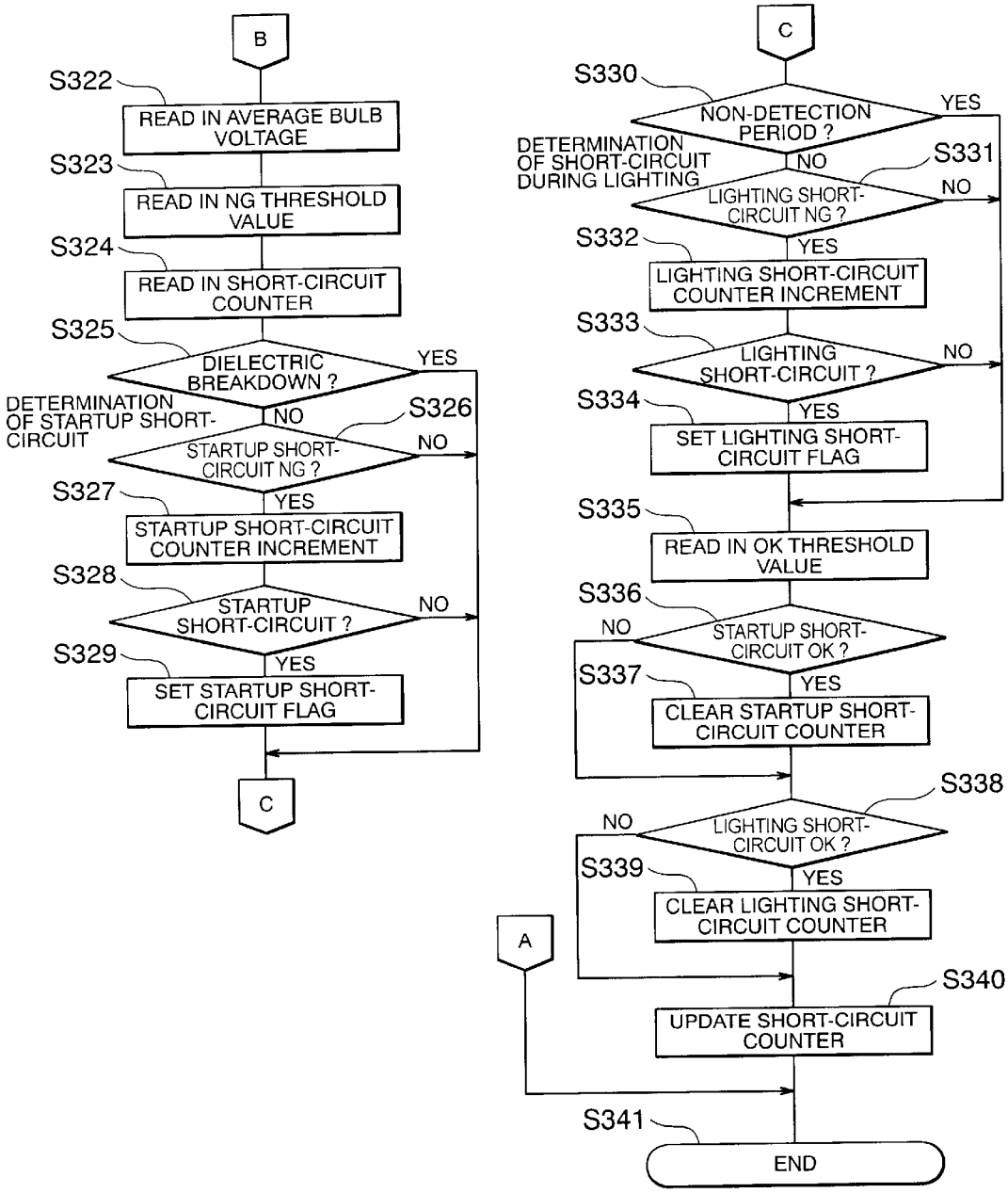
FIG. 4 is a flowchart illustrating the short-circuit/ground-fault determining process in embodiment 1 of the invention, together with FIG. 3.

FIGS. 3 and 4 form continuous flowcharts: "A" in FIG. 3 continues to "A" in FIG. 4 and "B" in FIG. 3 continues to "B" in FIG. 4. In FIG. 4, "C" continues to "C".

Upon starting the short-circuit ground-fault detecting process in S300, it is confirmed in S301 whether or not operation is in the lighting mode (i.e., a mode in which lighting operation of the discharge lamp is conducted). Modes other than the lighting mode include, for example, lighting preparation mode such as system checking. If determination is NO in this S301, the determination process of short-circuit/ground-fault is not carried out, and the operation transfers to the other control flow.

If determination is YES in S301, the time lapse from the start of lighting is read out from the memory storing such a time lapse in S302. In S303, it is determined whether or not the time lapse is within a non-determination period. If YES, ground-fault determination is not performed to proceed to the next short-circuit determination. If NO, the process advances to the next ground-fault determining step without taking any action. In S304, the bulb voltage data on the side A is read out from among the bulb voltage data stored in the memory in the microcomputer serving as the lighting stop determining section 16. In S305, the bulb voltage data on the side B is read out from among the bulb voltage data stored in the memory.

Rules such as detection and read of the bulb voltage on the sides A and B will be described later.

The time lapse from the start of lighting as used in S302 is calculated with occurrence of dielectric breakdown (the occurrence thereof is judged on whether or not the voltage waveform agrees with voltage waveform conditions upon dielectric breakdown), or the moment when a prescribed amount of current has flowed as the start of lighting. The term "the moment when a prescribed amount of current has flowed" is for inspecting the discharge lamp lighting device and is a condition provided so that a resistance is connected in place at the bulb position in a condition with no bulb attached, and the discharge lamp lighting device operates when carrying out various inspections before shipment. By providing such a condition, it is possible, in the inspection before shipment, to carry out inspections by connecting a substitute resistance without inspecting the device by actually attaching a bulb. It is therefore possible to create a bulb voltage of an arbitrary voltage value, easily conduct an inspection through simulation of a bulb in various states, and inspect even the behavior of the discharge lamp lighting device in a state of bulb which would not occur in an ordinary bulb.

The detecting/storing process flow of various bulb voltage values will be described later. The method for detecting the bulb voltage will now be described with reference to FIGS. 5(*a*) and 5(*b*).

Figure 5:
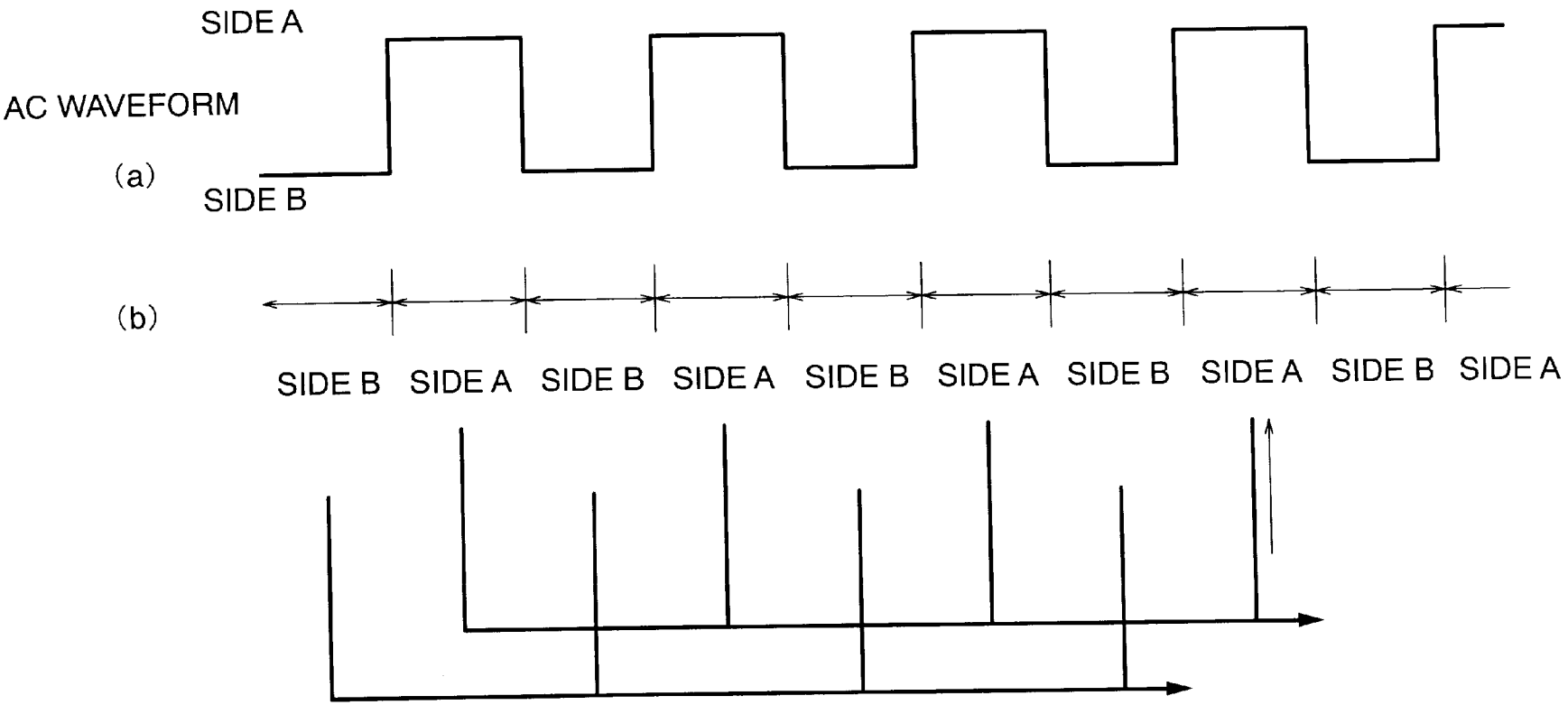
FIG. 5 is a descriptive view illustrating the relationship between the bulb voltage and AC current produced in the inverter circuit in embodiment 1 of the invention.

Because AC is impressed on the bulb 13 by a inverter circuit 12, voltage is applied alternately to the both ends of the bulb 13 (the output end not grounded at startup of the inverter circuit 12 is called the end A, and the other end, the end B), and the waveform thereof (at 400 Hz for example in this case) is as shown in FIG. 5(*a*). The voltage detected by the voltage detecting section 15 with this period can be parceled out into a voltage section on the side A and a voltage section on the side B as shown in FIG. 5(*b*). Voltage values of these individual sections are stored in the memory. Since voltage at a point is periodically switched over between the sides A and B by switching operation of the inverter circuit, it is possible to determine whether a voltage is that on the side A or that on the side B in accordance with the switching time. An average over four voltage values is stored for each of the sides A and B.

The inverter circuit and the igniter are arranged between the voltage detecting section and the grounding point. It is therefore necessary to correct the voltage caused by the resistance of these two circuits to determine a true bulb voltage.

Then in S 306, a ground-fault NG threshold value used for ground-fault determination is read in from the memory of the system, and in S307, the counter value stored in the ground-fault counter is read in, thereby completing pre-processing for ground-fault determination.

In S308, it is determined whether or not the status is NG (i.e., whether or not there is possibility of ground-fault) by comparing the bulb voltage on the side A and the NG threshold value. If NO, the process is transferred to determination of the bulb voltage on the side B by skipping counter addition and flag setting operations on the side A. If YES, on the other hand, an increment is made in the ground-fault counter (the counter value is increased by 1) on the side A in S309. In S310, it is determined whether or not the counter value resulting from increment is at least a prescribed value (for example 10 in this case). If YES, it is determined that a ground-fault occurs on the side A in S311, and a side A ground-fault flag is set. If NO, no flag is set as a result of skipping.

The ground-fault counter and the short-circuit counter serve to indicate the time of duration of a ground-fault or short-circuit state. The effect of noise exerted on the bulb voltage detecting section is alleviated by determining continuance of a ground-fault or short-circuit state for a certain period of time as being NG.

Then in S312, it is determined whether or not the status is NG (i.e., whether or not there is possibility of occurrence of a ground-fault) by comparing the bulb voltage on the side B and the NG threshold value. If NO, the counter addition and flag setting operation on the side B are skipped. If YES, on the other hand, an increment is made in the side B ground-fault counter (the counter value is increased by 1) in S313. In S314, it is determined whether or not the counter value resulting from increment is at least a prescribed value (for example 10 in this case). If YES, it is determined that a ground-fault occurs on the side B in S315, and a side B ground-fault flag is set. If NO, no flag is set as a result of skipping.

In S316, the OK threshold value is read out from the system memory, and in 317, it is determined whether or not the status is OK by comparing the side A bulb voltage and the OK threshold value. If YES, the side A ground-fault counter is cleared (the counter value is reset to 0) in S318. If NO, the process proceeds to S319 by skipping the steps in between. In S319, it is determined whether or not the status is OK by comparing the side B bulb voltage to the OK threshold value. If YES, the side B ground-fault counter is cleared (the counter value is reset to 0) in S320. If NO, the process is transferred to S321 by skipping the steps in between.

The steps S308 to S315 form a flow for NG determination of ground-fault, and the steps S316 to S321 form a flow for OK determination of ground-fault. These NG determination and OK determination will be described with reference to FIG. 6.

Figure 6:
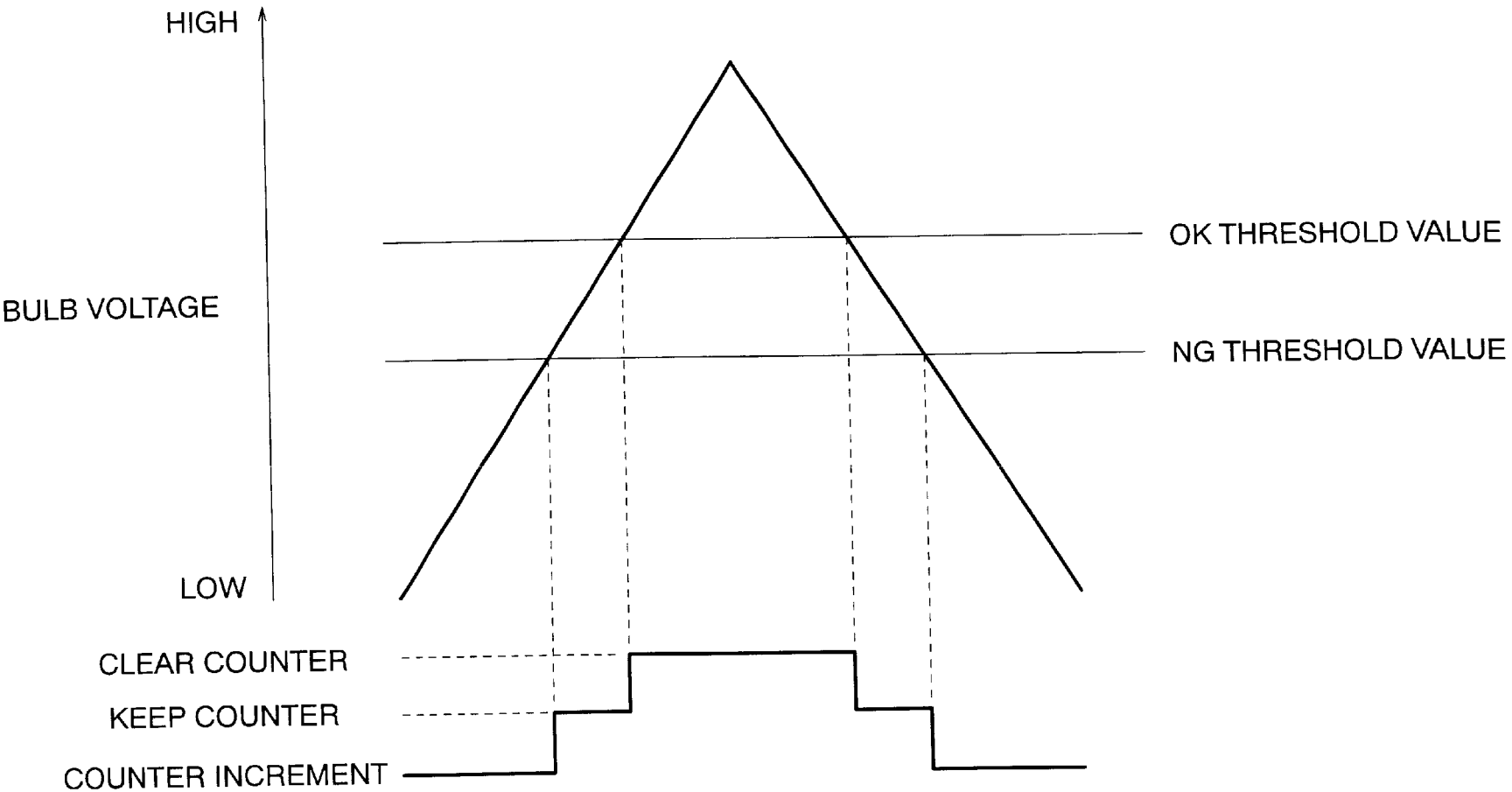
FIG. 6 is a descriptive view illustrating the relationship between the bulb voltage and the threshold value of ground-fault determination in embodiment 1 of the invention.

FIG. 6 illustrates the relationship of the bulb voltage with the NG threshold value and the OK threshold value. As shown in FIG. 6, the probability of occurrence of a ground-fault is high in the case of a bulb voltage from the grounding point (GND) to the NG threshold value. An increment is therefore made in the ground-fault counter. In the case of a bulb voltage of over the OK threshold value, the probability of occurrence of a ground-fault is the slightest. The ground-fault counter is therefore cleared. In FIG. 6, a hysteresis is provided in the ground-fault determination by shifting the OK threshold value and the NG threshold value, and making no determination as to occurrence of a ground-fault for values between the NG and OK threshold values with the ground-fault counter value as it is. It is also possible, as shown in FIG. 7, to make the OK threshold value and the NG threshold value equal to each other to simplify the process.

Figure 7:
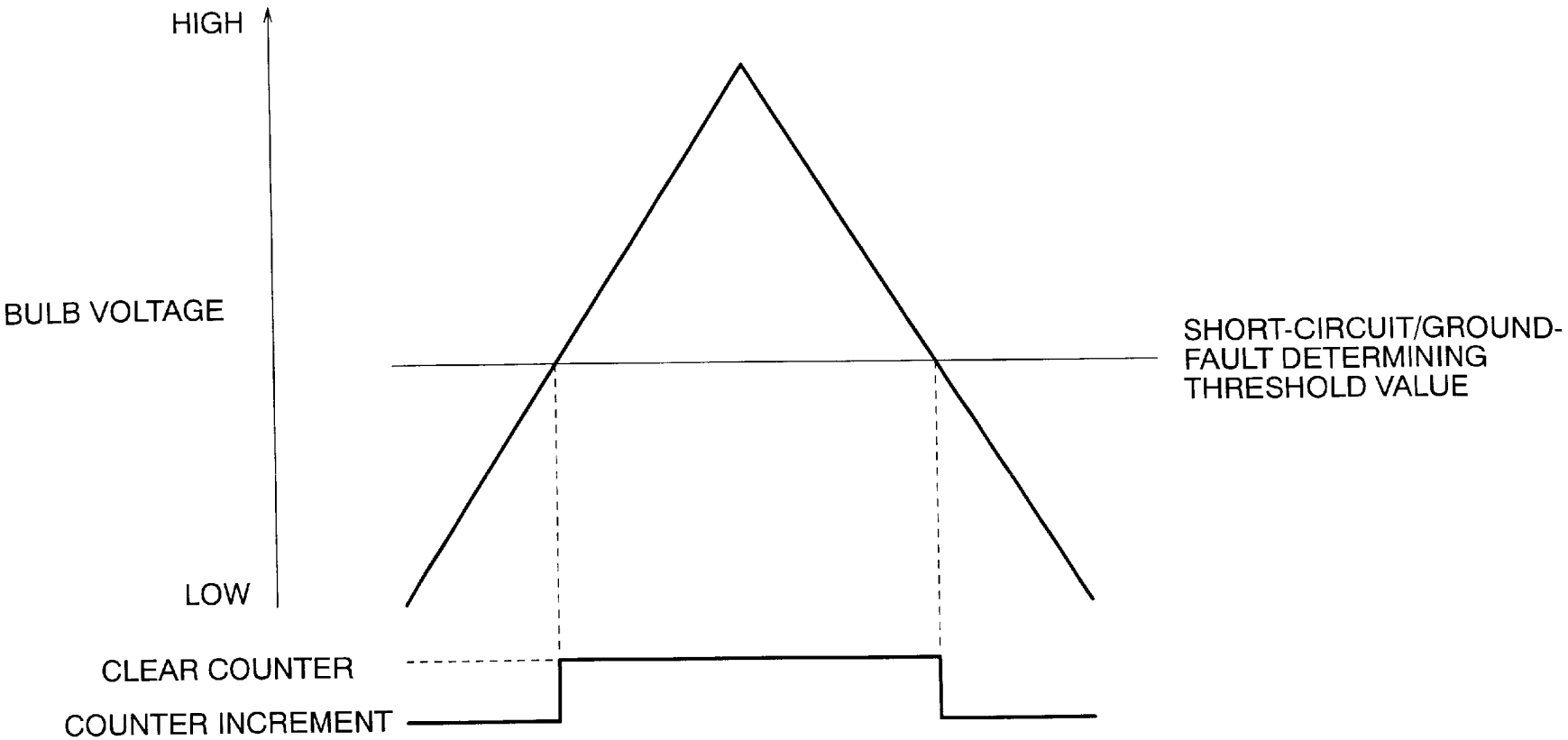
FIG. 7 is a descriptive view illustrating the relationship between the bulb voltage and the threshold of short-circuit determination in embodiment 1 of the invention.

FIGS. 6 and 7 show, in solid lines, a bulb voltage forming a peak and changes in the counter value caused by such a bulb voltage.

More specifically, in FIG. 6, the counter value is increased by one at a low bulb voltage, and at a bulb voltage of over the NG threshold value, the counter value is left as it is. When the bulb voltage is over the OK threshold value, the counter is cleared.

In FIG. 7, an increment is made in the counter when the bulb voltage is low, and the counter is cleared when the bulb voltage exceeds the short-circuit/ground-fault threshold value.

In S321, counter values resulting from ground-fault determination and OK determination on the sides A and B are stored by updating the ground-fault counter.

Then in S322 and the subsequent steps, the ground-fault determination is performed. First in S322, the average bulb voltage (an average over bulb voltage values on the sides A and B) is read from the system memory. In S323, the NG threshold value for short-circuit determination is read in. In S324, values stored in the short-circuit counter are read in.

Then in S325, it is determined whether or not dielectric breakdown of the bulb takes place. If YES, steps are skipped to S330. If NO, the process transfers to processing in S326. In S326, it is determined whether or not the status is NG (i.e., whether or not there is possibility of occurrence of a short-circuit at startup) by comparing the bulb voltage to the startup short-circuit NG threshold value. If NO, the process proceeds to short-circuit determination during lighting by skipping the startup short-circuit counter addition and flag setting steps. If YES, an increment is made in the startup short-circuit counter (increasing the counter value by 1) in S327. In S328, it is determined whether or not the counter value resulting from the increment is over a prescribed value (for example 10 in this case). If YES, it is determined that there occurs a startup short-circuit in S329, and a startup short-circuit flag is set. If NO, the steps are skipped, and no flag would be set.

Then in S330, it is determined whether or not the time lapse of lighting is within a non-detection period. If YES, the steps are skipped to S335. If NO, the process goes to S331 processing. In S331, it is determined whether or not the status is NG (i.e., whether or not there is a probability of occurrence of a short-circuit upon lighting) by comparing the bulb voltage to the short-circuit NG threshold value upon lighting. If NO, the steps of addition of short-circuit counter upon lighting and setting of a flag are skipped, and the process advances to S335. If YES, an increment is made in the lighting short-circuit counter (the counter value is increased by 1) in S332. In S333, it is determined whether or not the counter value resulting from the increment is over a prescribed value (for example 10 in this case). If YES, it is determined that a short-circuit upon lighting occurs in S334, and a lighting short-circuit flag is set. If NO, the steps are skipped, and no flag would be set.

S326 to S329 are steps forming the flow for NG determination of startup short-circuit. S331 to S334 are steps representing the flow for NG determination of lighting short-circuit. The steps S336 to S339 represent the flow for OK determination of startup short-circuit and lighting short-circuit. The NG determination and OK determination will be described with reference to FIG. 6.

FIG. 6 illustrates the relationship of the bulb voltage with the NG threshold value and the OK threshold value. As shown in FIG. 6, the probability of occurrence of a short-circuit is high in the case of a bulb voltage from the grounding point (GND) to the NG threshold value. An increment is therefore made in the startup short-circuit counter or the lighting short-circuit counter In the case of a bulb voltage of over the OK threshold value, the probability of occurrence of a short-circuit is almost null. The short-circuit counter is therefore cleared. In FIG. 6, a hysteresis is provided in the short-circuit determination by shifting the OK threshold value and the NG threshold value, and making no determination as to occurrence of a short-circuit for values between the NG and OK threshold values with the short-circuit counter value as it is. It is also possible, as shown in FIG. 7, to make the OK threshold value and the NG threshold value equal to each other to simplify the process.

It is possible in this case to set optimum values of startup short-circuit determining NG threshold value and lighting short-circuit determining NG threshold value to correspond to the temperature characteristics of the circuit element described later by using different values for these thresholds.

In S335, the OK threshold value is read in. S335 to S339 are steps forming the flow of OK determination of startup short-circuit and lighting short-circuit.

In 335, the short-circuit determining OK threshold value is read out from the system memory, and in S336, it is determined whether or not the status is OK by comparing the bulb voltage to the OK threshold value. If YES, the startup short-circuit counter is cleared (the counter value is reset to 0) in S337. If NO, the process advances to S338 by skipping the steps in between. In S338, it is determined whether or not the status is OK by comparing the bulb voltage to the OK threshold value. If YES, the lighting short-circuit counter is cleared (the counter value is reset to 0) in S339. If NO, the process is transferred to S340 by skipping the steps in between.

It is possible in this case to set optimum threshold values for the startup short-circuit determining OK threshold value and the lighting short-circuit determining OK threshold value, as in the case of the NG threshold values, by using different values for these thresholds.

Then in S340, the counter value resulting from short-circuit determination is stored in the short-circuit counter by updating, and the process is completed in S341, the process being moved to the other flow.

Figure 8:
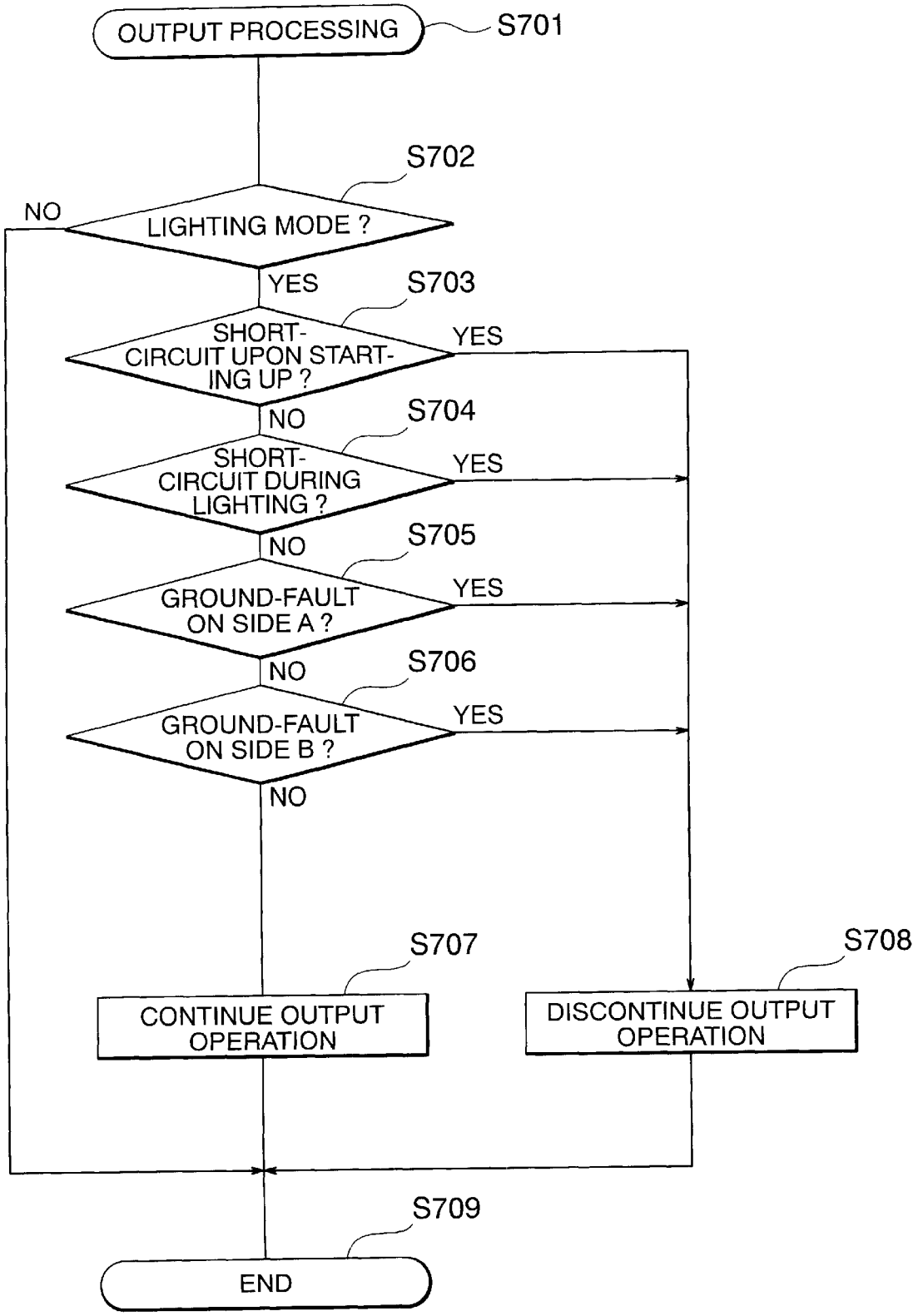
FIG. 8 is a flowchart illustrating the output operation stop determining process in embodiment 1 of the invention.

Then, in response to the result of determination as to ground-fault and short-circuit along the flow shown in FIGS. 3 and 4 (the side A ground-fault flag, the side B ground-fault flag, the startup short-circuit flag, and the lighting short-circuit flag, in this case), it is decided whether or not to execute output for discharge lamp lighting in accordance with the flow shown in FIG. 8.

The flow shown in FIG. 8 is started from S701, and it is confirmed whether or not the status is in the lighting mode from S702. In S703 to S706, the startup short-circuit flag, the lighting short-circuit flag, the side A ground-fault flag and the side B ground-fault flag are confirmed in this sequence. When any of these flags is valid, the process goes to S708, in which output operation is discontinued, and power supply to the bulb is stopped. When none of these flags is valid, on the other hand, the process advances to S707, and power supply to the bulb is continued.

According to this embodiment 1, it is determined whether or not there occurs a ground-fault or a short-circuit in the discharge lamp or in the power supply line to the discharge lamp, by comparing the voltage detected by the voltage detecting section to a threshold value corresponding to the ground-fault or the short-circuit, and the lighting operation is discontinued to stop lighting in response to the result of this determination. A non-detection period is provided as in S303 and S330 in the flow shown in FIGS. 3 and 4 so that no determination is made as to whether or not a ground-fault or a short-circuit occurs by the lighting stop determining section for a prescribed period after dielectric breakdown of the discharge lamp or for a prescribed period after flow of a prescribed amount of current to the discharge lamp. It is therefore possible to prevent an erroneous detection of a ground-fault or a short-circuit caused by the use of unstable bulb voltage in the initial stage of lighting.

Figure 12:
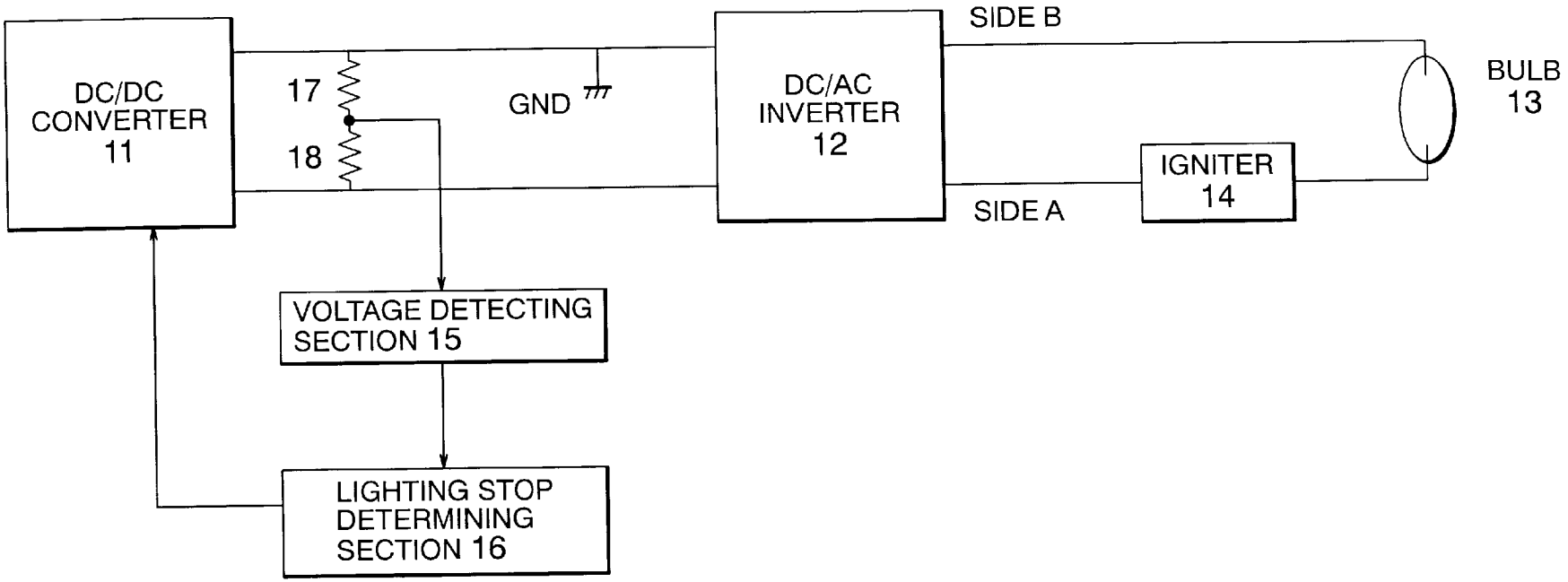
FIG. 12 is a block diagram representing a concrete example of the functional configuration of the discharge lamp lighting device of embodiment 1 of the invention.

In this embodiment 1 (in embodiments 2 and 3 described later as well), as shown in FIG. 12, the input to the voltage detecting section 15 may be made a partial voltage of the output of the DC/DC converter 11. In this case, it is recommendable to avoid that the maximum output of resistance value of partial voltage resistances 17 and 18 to the voltage detecting section 15 exceeds the rated voltage (for example, 5 V for a microcomputer) of the voltage detecting section 15 or the lighting stop determining section 16.

Embodiment 2

In this embodiment 2, in a discharge lamp lighting device having an igniter arranged on the side not grounded in the initial stage of lighting (side A) from among the output terminals of the inverter, in the flow shown in FIGS. 3 and 4, it is determined whether or not dielectric breakdown occurs before determination during the non-detection period in S303, and if no dielectric breakdown occurs, a ground-fault determination is performed for the bulb voltage on the side A.

This is based on the fact that, since dielectric breakdown necessarily takes place upon lighting a usual bulb, non-occurrence thereof and transfer to the lighting mode must suggest the possibility of occurrence of some abnormality or other.

Figure 9:
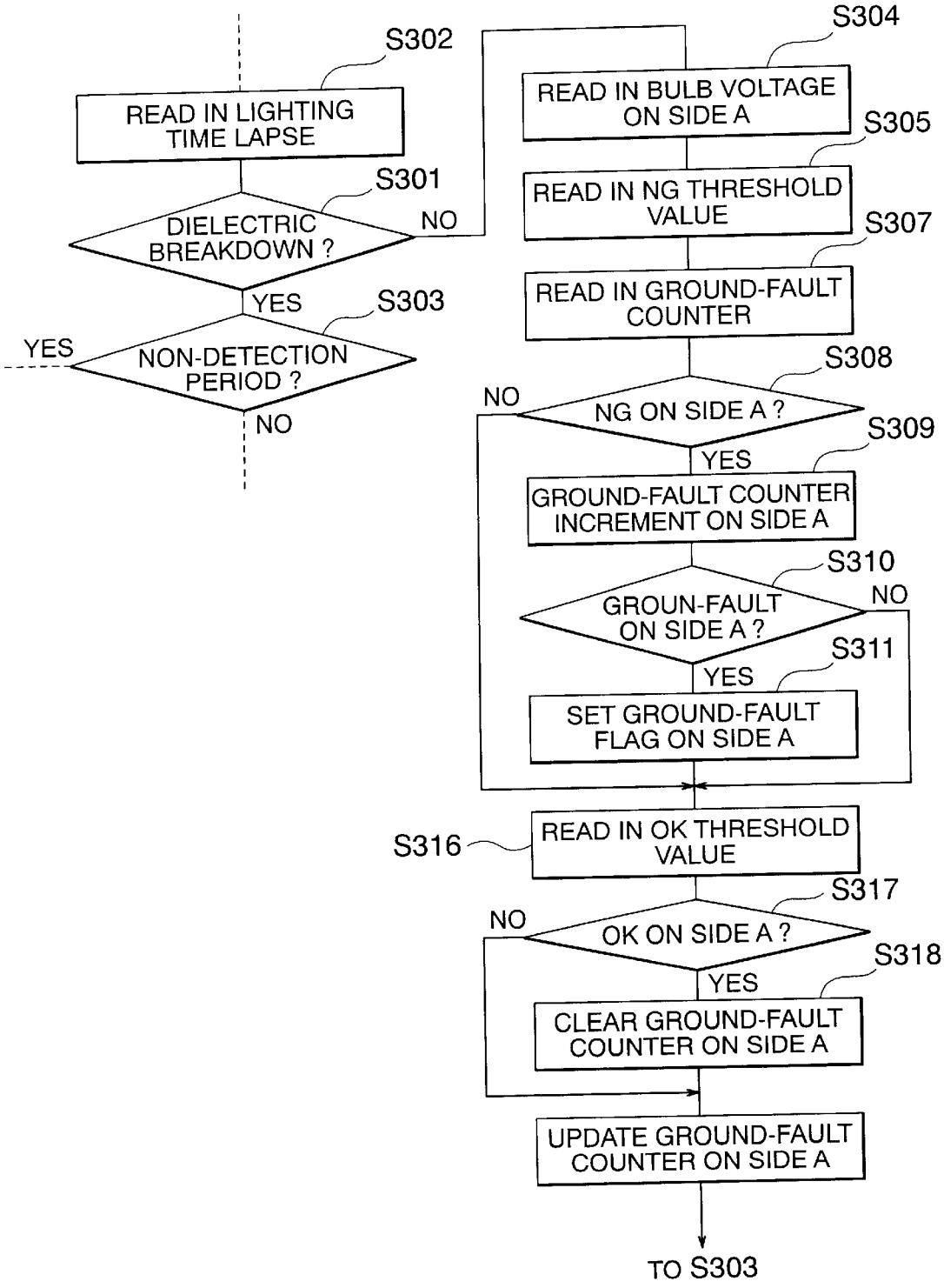
FIG. 9 is a flowchart illustrating the ground-fault determining process in embodiment 2 of the invention.

FIG. 9 illustrates the flow of steps in the embodiment 2, and describes only processes different from those in the above-mentioned embodiment 1.

First, while, in FIGS. 3 and 4, the process after S302 advances to S303, in FIG. 9, after S302, it is determined whether or not dielectric breakdown has occurred in S801. In this S801, if it is determined that dielectric breakdown has taken place, the process goes to S303 as in FIGS. 3 and 4. If it is determined that no dielectric breakdown has occurred, a ground-fault determination is performed for the bulb voltage on the side A (i.e., the non-detection side). For the ground-fault determination, already described in FIGS. 3 and 4, the same components as in embodiment 1 are assigned the same reference numerals, and the description thereof is omitted here.

In this embodiment 2, because of the condition of flowing of a prescribed amount of current, the second condition in terms of the lighting starting time, provided for product inspection, it is possible to prevent impossibility to detect a ground-fault caused by the bulb voltage exceeding the OK threshold value or the NG threshold value after the lapse of a non-detection period under the effect of temperature increase of the inverter circuit, an increase in resistance value in the inverter circuit and the resultant increase in voltage when current always flows during the non-detection period of S303 while continuing the state of ground-fault.

Figure 10:
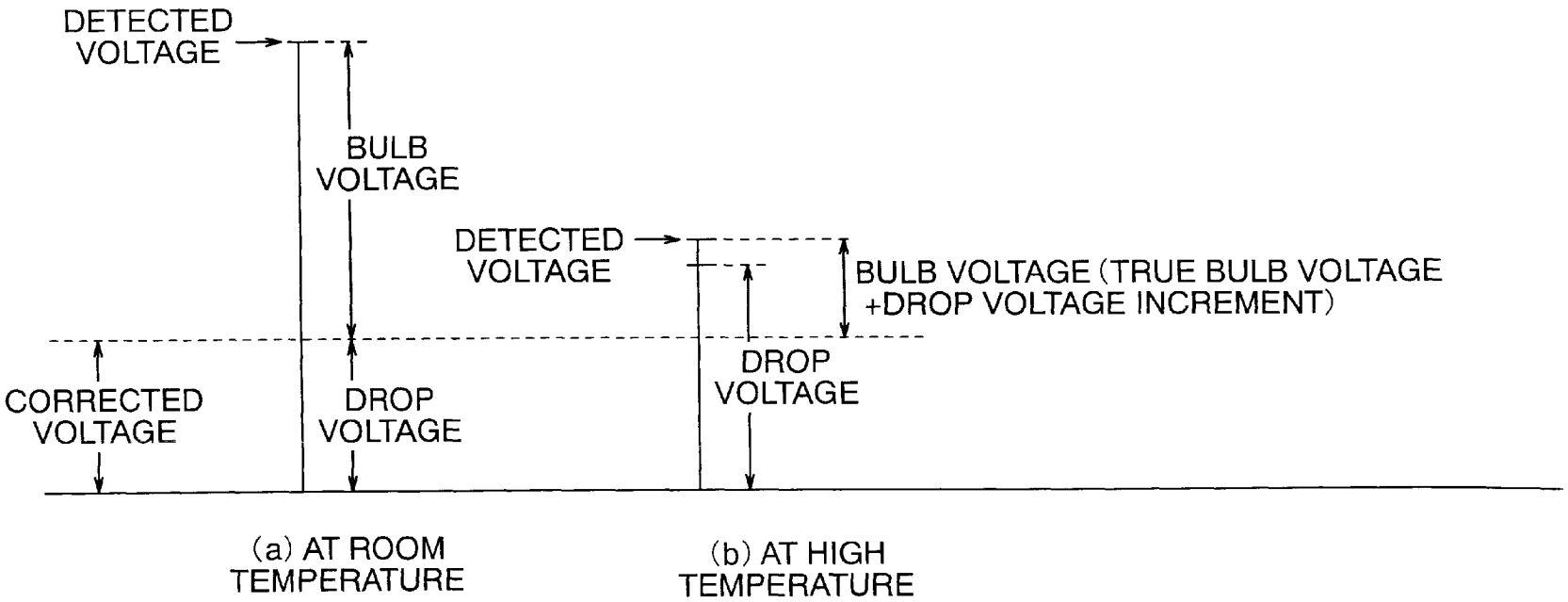
FIG. 10 is a descriptive view illustrating the relationship between the corrected voltage and the drop voltage resulting from an increase in temperature in embodiment 2 of the invention.

The problems involved in a change in resistance caused by a temperature increase will now be described with reference to FIG. 10. In FIG. 10, the detected voltage is a voltage detected by the voltage detecting section 15; the drop voltage is a voltage caused by resistance of circuits arranged between a voltage detecting point of the voltage detecting section 15 and the grounding point (GND); and the corrected voltage is a drop voltage which is previously determined through calculation and used for calculating a bulb voltage.

In FIG. 10(*a*) covering a case at the room temperature, there is no change in the resistance value from that used previously when calculating the corrected voltage and the voltage is equal to the actual drop voltage. It is therefore possible to obtain a correct bulb voltage value. However, in a case at a high temperature shown in FIG. 10(*b*), the resistance value increases with a temperature increase, and along with this, the drop voltage increases over the corrected voltage. Therefore, the bulb voltage determined through calculation takes a value obtained by adding an increment in the drop voltage from the true (actual) bulb voltage. For example, even when the actual bulb voltage is close to 0, a large increment brought about by the temperature increase of the drop voltage would cause the resultant voltage to exceed the threshold value for short-circuit or ground-fault determination.

This embodiment 2 has an object to solve the above-mentioned problems: the lighting stop determining section determines, prior to determination during the non-detection period in S303, whether or not a ground-fault has occurred in the voltage impressed on the igniter side (side A) of the discharge lamp before dielectric breakdown thereof. It is therefore possible to prevent impossibility to detect a ground-fault caused by a bulb voltage becoming higher than the NG voltage after the lapse of the non-detection period as a result of the flow of current resulting from the ground-fault during the non-detection period, a temperature increase of elements in the inverter circuit, and the resultant increase in resistance.

There is conceivable another solution of this problem of providing means for detecting a temperature increase of the resistance in the circuit. For example, a temperature sensor may be provided near the resistance suffering from the temperature increase, or the temperature increase of the resistance may be detected through a change in voltage between a voltage detecting section provided between the bulb and the circuit subject to temperature increase and the grounding point (GND). Another conceivable method is to set a slightly larger corrected voltage. It is however difficult to practically apply this method because the bulb voltage becomes smaller after correction at low temperatures, and this affects the rising of optical fluxes.

Embodiment 3

Embodiment 3 permits ground-fault determination at startup at any of the terminals of the discharge lamp by adopting a circuit confirmation in which, in the configuration of embodiment 2, utilizes the possibility to perform ground-fault determination at startup when ground-fault occurs on the side of a terminal not suffering from dielectric breakdown when the discharge lamp is subject to a ground-fault at startup, and no dielectric breakdown occurs even when causing a ground-fault in any of the terminals of the discharge lamp at startup.

Figure 11:
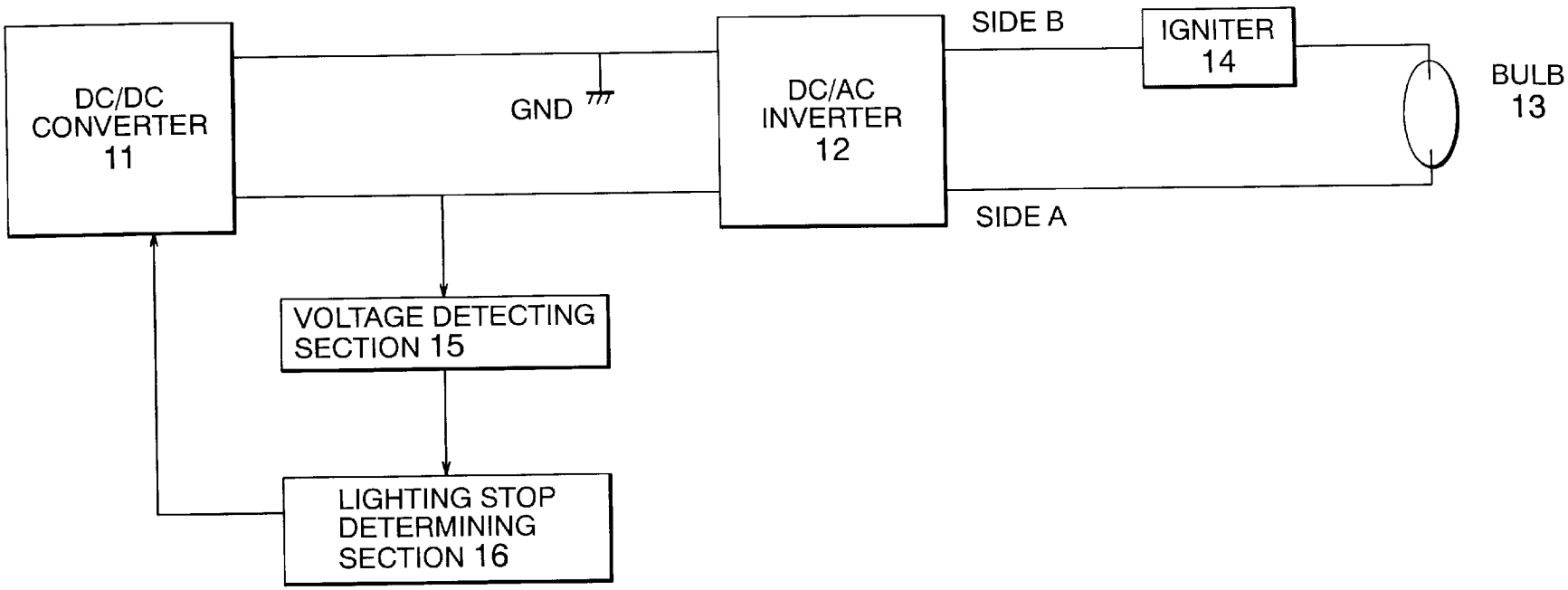
FIG. 11 is a block diagram illustrating the functional configuration of the discharge lamp lighting device of embodiment 3 of the invention.

FIG. 11 is a circuit block diagram illustrating embodiment 3. Ground-fault determination when causing a ground-fault in the discharge lamp will be described.

When causing a ground-fault for the terminal A at startup, the case is the same as the ground-fault determination in embodiment 2: it is possible to make a ground-fault determination.

When causing a ground-fault for the terminal B at startup, high-voltage pulses of the igniter are produced at GND, resulting in a fixed potential: an initial voltage causing dielectric breakdown of the discharge lamp is not supplied, and dielectric breakdown of the discharge lamp does not occur, thus permitting ground-fault determination.

The discharge lamp lighting device for an automobile headlight (front lamp) has particularly been described in the above-mentioned embodiments. The invention is applicable also to a discharge lamp lighting device for home uses or for a streetlamp.

The above-mentioned embodiments have the following features, respectively.

The lighting device of a discharge lamp of the present invention, which lights the discharge lamp by feeding power to the discharge lamp, comprises a voltage detecting section which detects voltage impressed on the discharge lamp, and a lighting stop determining section which determines, on the basis of the voltage detected by the voltage detecting section, whether or not a short-circuit or a ground-fault occurs in a power feed line to the discharge lamp, and stops lighting in response to the result of the determination, wherein determination whether or not a ground-fault or a short-circuit occurs is not made for a prescribed period of time after dielectric breakdown of the discharge lamp or for a prescribed period of time after flow of a prescribed current to the discharge lamp. It is therefore possible to prevent an erroneous detection caused by use of an unstable bulb voltage in the initial stage of lighting.

The invention provides also a lighting device of a discharge lamp, further comprising an igniter which feeds an initial voltage for causing dielectric breakdown of the discharge lamp, wherein the igniter is arranged on the side of the discharge lamp not grounded in the initial stage of lighting; and the lighting stop determining section determines whether or not a ground-fault occurs on the igniter side of the discharge lamp before dielectric breakdown of the discharge lamp. The lighting stop determining section would therefore determine, in the discharge lamp lighting device in which the igniter is arranged on the non-grounded side of the initial stage of lighting from among the output terminals of the inverter, whether or not a ground-fault occurs in a voltage impressed on the non-grounded side of the discharge lamp before dielectric breakdown of the discharge lamp. Current resulting from ground-fault flows during a prescribed time of non-determination, and temperature of the circuit element through which the current flows increases and there is a change in resistance value. After the lapse of a prescribed period of time, the voltage detecting section detects a higher voltage. The invention thus permits prevention of the resultant impossibility to detect a ground-fault.

The invention provides also a lighting device of a discharge lamp, further comprising an igniter which feeds an initial voltage for causing dielectric breakdown of the discharge lamp, wherein the igniter is arranged on the side of the discharge lamp grounded in the initial stage of lighting; and the lighting stop determining section determines whether or not a ground-fault occurs on any or both of the terminals on the both sides of the discharge lamp before dielectric breakdown of the discharge lamp. The lighting stop determining section can determine whether or not a ground-fault occurs as to the voltage impressed on any one or both of the terminals of the discharge lamp before dielectric breakdown of the discharge lamp, in the lighting device of the discharge lamp in which the igniter is arranged on the side grounded in the initial stage of lighting from among the output terminals of the inverter. Current resulting from ground-fault flows during a prescribed time of non-determination, and temperature of the circuit element through which the current flows increases and there is a change in resistance value. After the lapse of a prescribed period of time, the voltage detecting section detects a higher voltage. The invention permits prevention of the resultant impossibility to detect a ground-fault.

Industrial Applicability

The discharge lamp lighting device of the present invention relates, as described above, to a discharge lamp lighting device used for an automobile headlight and the like, and is particularly suitable for determining a short-circuit or a ground-fault in a discharge lamp.

What is claimed is:

1. A lighting device of a discharge lamp, which lights the discharge lamp by feeding power to the discharge lamp, comprising a voltage detecting section which detects voltage impressed on the discharge lamp, and a lighting stop determining section which determines, on the basis of said voltage detected by said voltage detecting section, whether or not a short-circuit or a ground-fault occurs in a power feed line to said discharge lamp, and stops lighting in response to the result of said determination, wherein determination whether or not a ground-fault or a short-circuit occurs is not made for a prescribed period of time after dielectric breakdown of said discharge lamp or for a prescribed period of time after flow of a prescribed current to said discharge lamp.

2. A lighting device of a discharge lamp according to claim 1, further comprising an igniter which feeds an initial voltage for causing dielectric breakdown of the discharge lamp, wherein said igniter is arranged on the side of said discharge lamp not grounded in the initial stage of lighting; and said lighting stop determining section determines whether or not a ground-fault occurs on said igniter side of said discharge lamp before dielectric breakdown of said discharge lamp.

3. A lighting device of a discharge lamp according to claim 1, further comprising an igniter which feeds an initial voltage for causing dielectric breakdown of the discharge lamp, wherein said igniter is arranged on the side of said discharge lamp grounded in the initial stage of lighting; and said lighting stop determining section determines whether or not a ground-fault occurs on any or both of the terminals on the both sides of said discharge lamp before dielectric breakdown of said discharge lamp.

* * * * *